US006268098B1

(12) United States Patent
Sugimoto et al.

(10) Patent No.: US 6,268,098 B1
(45) Date of Patent: Jul. 31, 2001

(54) FULL-COLOR ELECTROPHOTOGRAPHIC IMAGE FORMATION METHOD, COLOR TONERS FOR USE IN THE SAME, AND COLOR IMAGE FORMED BY USE OF THE COLOR TONERS

(75) Inventors: Shohichi Sugimoto; Shinichi Kuramoto, both of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/048,898

(22) Filed: Mar. 27, 1998

(30) Foreign Application Priority Data

Mar. 28, 1997 (JP) ..... 9-092745

(51) Int. Cl.[7] ..... G03G 9/087; G03G 9/097

(52) U.S. Cl. ..... 430/109; 430/106; 430/110; 430/111

(58) Field of Search ..... 430/42, 45, 106, 430/109, 110, 111

(56) References Cited

U.S. PATENT DOCUMENTS 5,061,588 * 10/1991 Fushimi et al. ..... 430/109
5,126,221 * 6/1992 Chiba et al. ..... 430/106
5,474,869 12/1995 Tomita et al. ..... 430/102
5,840,456 * 11/1998 Tomita et al. ..... 430/106
5,840,457 * 11/1998 Urawa et al. ..... 430/106
5,879,848 * 3/1999 Kurose et al. ..... 430/109

* cited by examiner

*Primary Examiner*—Janis L. Dote
(74) *Attorney, Agent, or Firm*—Oblon, Spivak, McClelland, Maier & Neustadt, P.C.

(57) ABSTRACT

An image formation method for forming a full-color image includes the step of superimposing four yellow, magenta, cyan and black toner images which are respectively obtained by developing four latent electrostatic images, which respectively correspond to the four yellow, magenta, cyan and black toner images, with a yellow toner, a magenta toner, a cyan toner and a black toner, wherein a gradient $a_Y$ of a yellow glossiness per unit amount of the yellow toner (mg/cm$^2$) deposited on a transfer sheet, a gradient $a_M$ of a magenta glossiness per unit amount of the magenta toner (mg/cm$^2$) deposited on the transfer sheet, and a gradient $a_C$ of a cyan glossiness per unit amount of the cyan toner (mg/cm$^2$) deposited on the transfer sheet are in a range of 0.8 a to 1.2 a, and a gradient $a_{Bk}$ of a black glossiness per unit amount of the black toner (mg/cm$^2$) deposited on the transfer sheet is in a range of 0.4 a to 0.7 a, in which $a=(a_Y+a_M+a_C)/3$.

6 Claims, 1 Drawing Sheet

FIGURE
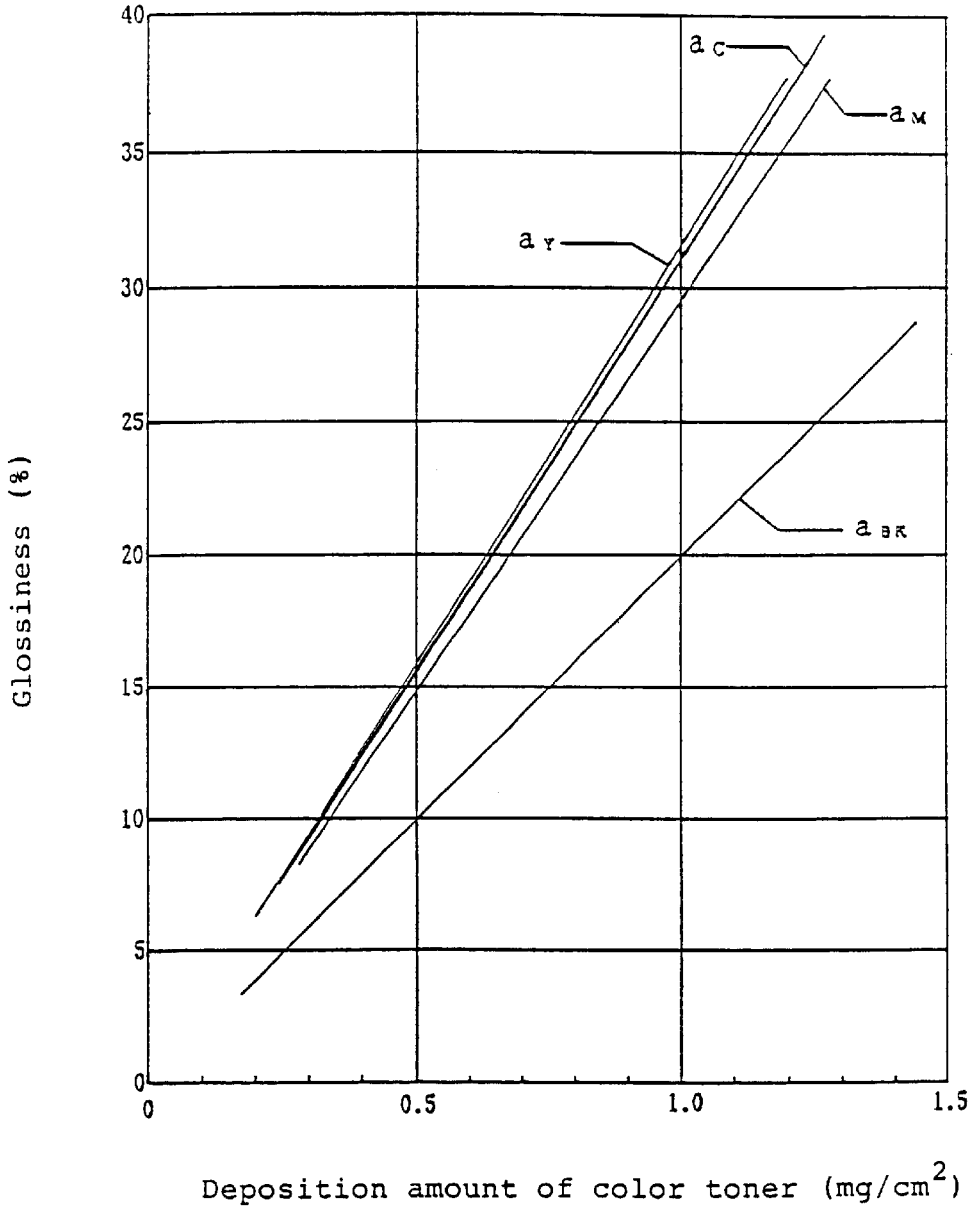

FULL-COLOR ELECTROPHOTOGRAPHIC IMAGE FORMATION METHOD, COLOR TONERS FOR USE IN THE SAME, AND COLOR IMAGE FORMED BY USE OF THE COLOR TONERS

BACKGROUND OF THE INVENTION

1. Field of the Invention

The present invention relates to an image formation method capable of producing a full-color image by superimposing four yellow, magenta, cyan and black toner images in the field of electrophotographic recording, a set of color toners for use in the above-mentioned full-color electrophotographic image formation method, and a color image formed by the above-mentioned full-color image formation method.

2. Discussion of Background

A color copying machine and a color printer employing the electrophotographic process have been widely used in recent years. In the electrophoto-graphic process for producing a color image, there are employed yellow, magenta and cyan toners, optionally a black toner being added thereto when necessary.

The color image is required to have a proper degree of glossiness. To fulfill the above requirement, a binder resin with a relatively low softening point is conventionally used for a color toner so as to make the surface of a toner layer constituting a color image area flat.

The amount of color toner deposited on a transfer sheet by development widely varies in a color image such as a full-color photographic image formed by the electrophotographic method of producing a full-color image. To be more specific, chromatic color images include many portions with the deposition amount of a color toner being small, while a black image is provided with a large amount of a black toner. The conventional full-color image in which the deposition amount of color toner shows some scatter, as mentioned above, has the shortcoming that the glossiness tends to be uneven in the entire image. In addition, the glossiness of the black image portion is extremely high, and the image will become dull as a whole.

The glossiness of the black image portion can be reduced when the black toner comprises as the binder resin the same resin as employed in the monochrome toner or a polymeric resin with a relatively high softening point. In such a case, however, there is the problem that a photographic image including a black image portion, such as a photographic image of a man's face, becomes considerably unattractive. In particular, when a color image includes a character image and a photographic image, both the character image and the photographic image become dull because there is a great difference in glossiness between a highlight portion of the photographic image and the character image portion.

There is a proposal in Japanese Laid-Open Patent Application 8-220821 to solve the problem of uneven glossiness in the full-color image. Namely, full-color images are formed by use of chromatic color toners, that is, yellow, magenta and cyan toners in combination with a transparent toner capable of producing a transparent image with a specified glossiness. This method, however, cannot be applied to the conventional electrophotographic copying machine because the transparent toner is additionally employed.

SUMMARY OF THE INVENTION

Accordingly, a first object of the present invention is to provide an electrophotographic full-color image formation method capable of producing attractive full-color images with even glossiness by reducing the glossiness of a black image portion.

A second object of the present invention is to provide a set of yellow, magenta, cyan and black toners for use with the above-mentioned electrophotographic full-color image formation method.

A third object of the present invention is to provide a color image formed by the above-mentioned electrophotographic full-color image formation method using the above-mentioned set of color toners.

The first object of the present invention can be achieved by an image formation method for forming a color image comprising the step of superimposing four yellow, magenta, cyan and black toner images which are respectively obtained by developing four latent electrostatic images, which respectively correspond to the four yellow, magenta, cyan and black toner images, with a yellow toner, a magenta toner, a cyan toner and a black toner, wherein a gradient $a_Y$ of a yellow glossiness per unit amount of the yellow toner (mg/cm$^2$) deposited on a transfer sheet, a gradient $a_M$ of a magenta glossiness per unit amount of the magenta toner (mg/cm$^2$) deposited on a transfer sheet, and a gradient $a_C$ of a cyan glossiness per unit amount of the cyan toner (mg/cm$^2$) deposited on a transfer sheet are in a range of 0.8 a to 1.2 a, and a gradient $a_{BK}$ of a black glossiness per unit amount of the black toner (mg/cm$^2$) deposited on a transfer sheet is in a range of 0.4 a to 0.7 a, in which $a=(a_Y+a_M+a_C)/3$.

The second object of the present invention can be achieved by a set of a yellow toner, a magenta toner, a cyan toner and a black toner, for forming a full-color image by superimposing four yellow, magenta, cyan and black toner images which are respectively obtained by developing four latent electrostatic images, which respectively correspond to the four yellow, magenta, cyan and black toner images, with the yellow toner, the magenta toner, the cyan toner and the black toner, wherein a gradient $a_Y$ of a yellow glossiness per unit amount of the yellow toner (mg/cm$^2$) deposited on a transfer sheet, a gradient $a_M$ of a magenta glossiness per unit amount of the magenta toner (mg/cm$^2$) deposited on a transfer sheet, and a gradient $a_C$ of a cyan glossiness per unit amount of the cyan toner (mg/cm$^2$) deposited on a transfer sheet are in a range of 0.8 a to 1.2 a, and a gradient $a_{BK}$ of a black glossiness per unit amount of the black toner (mg/cm$^2$) deposited on a transfer sheet is in a range of 0.4 a to 0.7 a, in which $a=(a_Y+a_M+a_C)/3$.

The third object of the present invention can be achieved by a full-color image formed by superimposing four yellow, magenta, cyan and black toner images which are respectively obtained by developing four latent electrostatic images, which respectively correspond to the four yellow, magenta, cyan and black toner images, with a yellow toner, a magenta toner, a cyan toner and a black toner, wherein a gradient $a_Y$ of a yellow glossiness per unit amount of the yellow toner (mg/cm$^2$) deposited on a transfer sheet, a gradient $a_M$ of a magenta glossiness per unit amount of the magenta toner (mg/cm$^2$) deposited on a transfer sheet, and a gradient $a_C$ of a cyan glossiness per unit amount of the cyan toner (mg/cm$^2$) deposited on a transfer sheet are in a range of 0.8 a to 1.2 a, and a gradient $a_{BK}$ of a black glossiness per unit amount of the black toner (mg/cm$^2$) deposited on a transfer sheet is in a range of 0.4 a to 0.7 a, in which $a=(a_Y+a_M+a_C)/3$.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

a single FIGURE is a graph which shows the relationship between the deposition amount of a color toner on a transfer sheet and the glossiness of a solid image formed on the transfer sheet by use of the color toner, in explanation of a gradient of the glossiness per unit amount of the color toner deposited on a transfer sheet.

DESCRIPTION OF THE PREFERRED EMBODIMENTS

According to the full-color image formation method of the present invention, latent electrostatic images are developed to yellow, magenta, cyan and black images with a yellow toner, a magenta toner, a cyan toner and a black toner respectively, and the developed yellow, magenta, cyan and black toner images are superimposed, so that a full-color image is formed on a transfer sheet. In this case, when the developed yellow toner image, magenta toner image, cyan toner image, and black toner image are independently transferred to the transfer sheet, the glossiness of each color toner image is substantially in proportion to the deposition amount of color toner. In the present invention, a gradient ($a_Y$) of a yellow glossiness per unit amount of the yellow toner deposited on the transfer sheet, a gradient ($a_M$) of a magenta glossiness per unit amount of the magenta toner deposited thereon, and a gradient ($a_C$) of a cyan glossiness per unit amount of the cyan toner deposited thereon are in the range of 0.8 a to 1.2 a, preferably in the range of 0.9 a to 1.1 a; and a gradient ($a_{BK}$) of a black glossiness per unit amount of the black toner deposited thereon is in the range of 0.4 a to 0.7 a, wherein $a=(a_Y+a_M+a_C)/3$. Therefore, even though the amount of color toner deposited on a transfer sheet per unit area widely varies in a color image, the glossiness of a black image portion, of which toner deposition amount is larger than that of the chromatic color image portion, can be reduced so as to have a proper glossiness. Thus, the color image becomes attractive as a whole.

The glossiness of the color toner image is measured by the following method: A set of color toners is incorporated in a commercially available electrophotographic copying machine "PRETER 550" (Trademark), made by Ricoh Company, Ltd. A solid color image is separately formed on a commercially available transfer sheet "Type 6000-70W" (Trademark), made by Ricoh Company, Ltd., using each of yellow, magenta, cyan and black toners. At that time, development is repeated in such a manner that the deposition amount of color toner on the transfer sheet is increased by 0.20 mg/cm$^2$ within the range of 0.20 to 1.4 mg/cm$^2$. Every time the solid color image is transferred to the transfer sheet, the image is fixed thereon at 160° C.

The glossiness of the thus obtained solid color image sample is measured using a commercially available glossmeter "VG-1D" (Trademark), made by Nippon Denshoku Kogyo Co., Ltd., with the incident angle and the reflection angle being set to 60°.

The gradient of a glossiness per unit amount of a color toner deposited on the transfer sheet for the formation of a single color toner image is calculated by plotting the deposition amount of toner (mg/cm$^2$) as abscissa, and the glossiness (%) of the solid image formed on the transfer sheet as ordinate, as shown in the single FIGURE.

It is desirable that the glossiness of a black image portion be 5.0% or more when the deposition amount of black toner is 0.8 mg/cm$^2$. Thus, the glossiness of the black image portion can be effectively reduced, and there can be obtained a color image with even glossiness.

In general, the lower the softening point of a binder resin for use in the chromatic color toner, the higher the glossiness of the obtained color image. The gradient of a glossiness of a color image per unit deposition amount of color toner can be controlled by selecting the kind of binder resin for use in the color toner, determining the combination of those binder resins, and adding a glossiness controlling agent capable of adjusting the glossiness to the black toner.

Each of the yellow, magenta, cyan and black toners comprise a binder resin and a coloring agent.

Specific examples of such a binder resin for use in the present invention include polyol resins homopolymers of styrene or substituted styrenes such as styrene-acryl copolymer, polystyrene, polychlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylethyl ether copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; and polymethyl methacrylate, polybutyl methacrylate, polyvinyl chloride, polyvinyl acetate, polyethylene, polypropylene, polyester, polyvinylbutyl butyral, polyacrylic resin, rosin, modified rosin, terpene resin, phenolic resin, aliphatic hydrocarbon resin, alicyclic hydrocarbon resin, aromatic petroleum resin, chlorinated paraffin, and paraffin wax. These binder resins can be used alone or in combination.

When the binder resin for use in each of the yellow, magenta and cyan toners has a softening point ($Sp_{YMC}$) and the binder resin for use in the black toner has a softening point ($Sp_{BK}$), it is preferable to satisfy the relationship of $Sp_{YMC}+10 \leqq Sp_{BK} \leqq Sp_{YMC}+20$.

By controlling the softening points of the binder resins for use in the yellow, magenta, cyan and black toners in the above-mentioned manner, there can be obtained attractive color images with even glossiness, and in addition, the fixing performance of the toner images can be improved.

It is desirable that the melting viscosity of the resin for use in each of the yellow, magenta and cyan toners be in the range of $5\times10^2$ to $5\times10^4$ Pa·sec at 100° C., and the melting viscosity of the resin for use in the black toner be in the range of $1\times10^3$ to $1\times10^5$ Pa·sec at 100° C.

The softening point and the melting viscosity of the binder resin for use in the toner are measured using a commercially available flow tester of capillary type, "CFT-500" (Trademark), made by Shimadzu Corporation. A sample of the resin (1 cm$^3$) is placed in the cylinder of the tester, and the temperature is increased by 6° C./min. A pressure of 20 kg/cm$^2$ is applied to the resin sample so as to extrude the resin sample through a small orifice with a diameter of 1 mm in the die. The height of the sample resin in the cylinder decreases as the resin initiates to flow through the orifice. The softening point of the sample resin is regarded as a temperature at which the height of the resin sample reaches ½ the original height.

The melt viscosity of the resin sample is calculated from the viscosity measured by the above-mentioned method at 100° C.

It is preferable that the binder resin for use in the black toner comprise a plurality of resin components, with at least one resin component being incompatible with other resin components. In this case, high quality image can be obtained without uneven glossiness.

Furthermore, it is preferable that the binder resin for use in the black toner comprise a polyol resin and a styrene-acryl copolymer in combination at a mixing ratio by weight of (95:5) to (60:40). When the mixing ratio of the styrene-acryl copolymer to the polyol resin is within the above-mentioned range, the glossiness of the black image portion can be effectively and properly reduced, and in addition, the fixing performance of the black image portion is satisfactory. When the black toner comprises the above-mentioned two kinds of binder resins at such a mixing ratio, the glossiness of the black image portion can be properly reduced, so that the entire color image formed on the transfer sheet is provided with well-balanced even glossiness.

It is further preferable that the softening point of the styrene-acryl copolymer be higher than that of the polyol resin by 10° C. or more. In such a case, more attractive color image can be obtained.

Further, it is preferable that the binder resins for use in the yellow toner, magenta toner and cyan toner comprise a polyol resin, and the binder resin for use in the black toner comprise a polyol resin and a styrene acryl copolymer resin.

In the present invention, it is preferable that the black toner further comprise a glossiness controlling agent in the form of finely-divided particles with an average particle diameter of 0.1 to 0.8 $\mu$m. By the addition of such finely-divided particles to the black toner, the entire glossiness of the color image can be adjusted.

It is preferable that the amount of the above-mentioned glossiness controlling agent be in the range of 0.2 to 15 wt. % of the total weight of the black toner.

Examples of the above-mentioned glossiness controlling agent include particles of inorganic compounds such as $TiO_2$, $Al_2O_3$, $CaCO_{31}$, MgO, CuO, ZnO, $ZnCrO_4$, ZnS, $BaSO_4$, $PbTiO_2$, $Cr_2O_3$, and $SrCrO_4$; and particles of resins such as polymethyl methacrylate and vinylidene fluoride. Those particles can be used alone or in combination.

The color toner may further comprise a variety of additives, such as colloidal silica, hydrophobic silica, metallic salts of fatty acids such as zinc stearate and aluminum stearate, metallic oxides such as titanium oxide, aluminum oxide, tin oxide and antimony oxide, and fluoropolymers.

Any conventional dyes and pigments can be used as the coloring agents for use in the color toners of the present invention.

Examples of the dyes and pigments include carbon black, nigrosine dyes, iron black, Naphthol Yellow S, HANSA YELLOW (10 G, 5 G, G), cadmium yellow, yellow iron oxide, ochre, chrome yellow, Titan Yellow, Oil Yellow, HANSA YELLOW (GR, A, RN, R), Pigment Yellow L, Benzidine Yellow (G, GR), Permanent Yellow (NCG), VULCAN FAST YELLOW (5 G, R), Tartrazine Lake, Quinoline Yellow Lake, Anthragen Yellow BGL, isoindolinone yellow, Bengale, red iron oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (E2R, F4R, FRL, FRLL, F4RH), Fast Scarlet VD, VULCAN FAST RUBINE B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone Red, Pyrazolone Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, Viridian Emerald Green, Pigment Green B, Naphthol Green B, Green Gold, Acid Green Lake, Malachite Green Lake, Phthalocyanine Green, Anthraquinone Green, titanium oxide, zinc flower, lithopone, and mixtures thereof.

It is preferable that the amount of the coloring agent be in the range of 0.1 to 50 parts by weight to 100 parts by weight of the binder resin.

Each color toner of the present invention may further comprise a charge control agent when necessary.

Any conventional charge control agents can be used in the present invention. For instance, a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing activator material, and metallic salts of salicylic acid and derivatives thereof are usable.

The amount of charge control agent for use in the color toner may be determined in light of the kind of binder resin to be employed, the presence or absence of additives, and the preparation method of the toner including the method of dispersing the composition of the toner. It is preferable that the amount of charge control agent be in the range of 0.1 to 10 parts by weight, and more preferably in the range of 2 to 5 parts by weight, to 100 parts by weight of the binder resin. By the addition of the charge control agent in such an amount, sufficient chargeability for use in practice can be imparted to the toner. Further, when the color toner of the present invention is used in combination with a carrier, electrostatic attraction of the toner to the carrier can be prevented from extremely increasing, so that the decrease of fluidity of the obtained two-component developer can be avoided. Thus, the decrease of image density can be prevented.

A plurality of charge control agents may be used in the present invention.

The color toner of the present invention may be used as a one-component developer, or a two-component developer in combination with the carrier, as previously mentioned.

For the preparation of the two-component developer, any conventional materials for the carrier such as iron powder, ferrite and glass beads are usable. Those materials may be coated with a resin such as polyvinyl fluoride, polyvinyl chloride, polyvinylidene chloride, phenolic resin, polyvinyl acetal, or silicone resin.

With respect to the mixing ratio in the two-component developer, it is proper that the amount of toner be in the range of about 0.5 to 6.0 parts by weight to 100 parts by weight of the carrier.

Other features of this invention will become apparent in the course of the following description of exemplary embodiments, which are given for illustration of the invention and are not intended to be limiting thereof.

EXAMPLE 1

[Preparation of Color Toners]

(Formulation for Yellow Toner No. 1)

| | Parts by Weight |
|---|---|
| Coloring agent: | |
| Diazo-based yellow pigment C.I. Pigment Yellow 17 | 5 |
| Resin: | |
| Polyol resin (Mn = 3600, Mw/Mn = 4.2, Tg = 60° C., Softening point = 110° C.) | 100 |
| Charge control agent: | |
| Zinc salicylate derivative (Trademark "BONTRON E84", made by Orient Chemical Industries, Ltd.) | 2 |

(Formulation for Magenta Toner No. 1)

| | Parts by Weight |
|---|---|
| Coloring agent: | |
| Quinacridone-based magenta pigment C.I. Pigment Red 122 | 4 |
| Resin: | |
| Polyol resin (Mn = 3600, Mw/Mn = 4.2, Tg = 60° C., Softening point = 110° C.) | 100 |
| Charge control agent: | |
| Zinc salicylate derivative (Trademark "BONTRON E84", made by Orient Chemical Industries, Ltd.) | 2 |

(Formulation for Cyan Toner No. 1)

| | Parts by Weight |
|---|---|
| Coloring agent: | |
| Copper phthalocyanine blue pigment C.I. Pigment Blue 15 | 2 |
| Resin: | |
| Polyol resin (Mn = 3600, Mw/Mn = 4.2, Tg = 60° C., Softening point = 110° C.) | 100 |
| Charge control agent: | |
| Zinc salicylate derivative (Trademark "BONTRON E84", made by Orient Chemical Industries, Ltd.) | 2 |

(Formulation for Black Toner No. 1)

| | Parts by Weight |
|---|---|
| Coloring agent: | |
| Carbon black | 6 |
| Resin: | |
| Polyol resin (Mn = 3600, Mw/Mn = 4.2, Tg = 60° C., Softening point = 110° C.) | 100 |

-continued

| | Parts by Weight |
|---|---|
| Charge control agent: | |
| Zinc salicylate derivative (Trademark "BONTRON E84", made by Orient Chemical Industries, Ltd.) | 2 |

The above-mentioned components of the formulation for each color toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 $\mu$m.

Thus, yellow (Y), magenta (M), cyan (C) and black (Bk) color toners were obtained.

EXAMPLE 2

[Preparation of Color Toners]

(Formulation for Yellow Toner No. 2)

| | Parts by Weight |
|---|---|
| Coloring agent: | |
| Diazo-based yellow pigment C.I. Pigment Yellow 17 | 5 |
| Resin: | |
| Polyester resin (Mn = 5400, Mw/Mn = 3.5, Tg = 61° C., Softening point = 110° C., Acid value = 9) | 100 |
| Charge control agent: | |
| Zinc salicylate derivative (Trademark "BONTRON E84", made by Orient Chemical Industries, Ltd.) | 2 |

(Formulation for Magenta Toner No. 2)

| | Parts by Weight |
|---|---|
| Coloring agent: | |
| Quinacridone-based magenta pigment C.I. Pigment Red 122 | 4 |
| Resin: | |
| Polyester resin (Mn = 5400, Mw/Mn = 3.5, Tg = 61° C., Softening point = 110° C., Acid value = 9) | 100 |
| Charge control agent: | |
| Zinc salicylate derivative (Trademark "BONTRON E84", made by Orient Chemical Industries, Ltd.) | 2 |

(Formulation for Cyan Toner No. 2)

| | Parts by Weight |
|---|---|
| Coloring agent: | |
| Copper phthalocyanine blue pigment C.I. Pigment Blue 15 | 2 |

-continued

| | Parts by Weight |
|---|---|
| Resin: | |
| Polyester resin (Mn = 5400, Mw/Mn = 3.5, Tg = 61° C., Softening point = 110° C., Acid value = 9) | 100 |
| Charge control agent: | |
| Zinc salicylate derivative (Trademark "BONTRON E84", made by Orient Chemical Industries, Ltd.) | 2 |

(Formulation for Black Toner No. 2)

| | Parts by Weight |
|---|---|
| Coloring agent: | |
| Carbon black | 6 |
| Resin: | |
| Polyester resin (Mn = 5400, Mw/Mn = 3.5, Tg = 61° C., Softening point = 110° C., Acid value = 9) | 100 |
| Charge control agent: | |
| Zinc salicylate derivative (Trademark "BONTRON E84", made by Orient Chemical Industries, Ltd.) | 2 |

The above-mentioned components of the formulation for each color toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 $\mu$m.

Thus, yellow (Y), magenta (M), cyan (C) and black (Bk) color toners were obtained.

EXAMPLE 3

[Preparation of Color Toners]

(Formulation for Yellow Toner No. 3)

| | Parts by Weight |
|---|---|
| Coloring agent: | |
| Diazo-based yellow pigment C.I. Pigment Yellow 17 | 5 |
| Resin: | |
| Polyol resin (Mn = 4700, Mw/Mn = 6.5, Tg = 62° C., Softening point = 124° C.) | 100 |
| Charge control agent: | |
| Zinc salicylate derivative (Trademark "BONTRON E84", made by Orient Chemical Industries, Ltd.) | 2 |

(Formulation for Magenta Toner No. 3)

| | Parts by Weight |
|---|---|
| Coloring agent: | |
| Quinacridone-based magenta pigment C.I. Pigment Red 122 | 4 |
| Resin: | |
| Polyol resin (Mn = 4700, Mw/Mn = 6.5, Tg = 62° C., Softening point = 124° C.) | 100 |
| Charge control agent: | |
| Zinc salicylate derivative (Trademark "BONTRON E84", made by Orient Chemical Industries, Ltd.) | 2 |

(Formulation for Cyan Toner No. 3)

| | Parts by Weight |
|---|---|
| Coloring agent: | |
| Copper phthalocyanine blue pigment C.I. Pigment Blue 15 | 2 |
| Resin: | |
| Polyol resin (Mn = 4700, Mw/Mn = 6.5, Tg = 62° C., Softening point = 124° C.) | 100 |
| Charge control agent: | |
| Zinc salicylate derivative Trademark "BONTRON E84", made by Orient Chemical Industries, Ltd.) | 2 |

(Formulation for Black Toner No. 3)

| | Parts by Weight |
|---|---|
| Coloring agent: | |
| Carbon black | 6 |
| Resin: | |
| Polyol resin (Mn = 4700, Mw/Mn = 6.5, Tg = 62° C., Softening point = 124° C.) | 100 |
| Charge control agent: | |
| Zinc salicylate derivative (Trademark "BONTRON E84", made by Orient Chemical Industries, Ltd.) | 2 |

The above-mentioned components of the formulation for each color toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 $\mu$m.

Thus, yellow (Y), magenta (M), cyan (C) and black (Bk) color toners were obtained.

EXAMPLE 4

[Preparation of Black Toner]

(Formulation for Black Toner No. 4)

| | Parts by Weight |
|---|---|
| Coloring agent: | |
| Carbon black | 6 |
| Resin: | |
| Polyol resin (Mn = 5500, Mw/Mn = 8.0, Tg = 68° C., Softening point = 135° C.) | 100 |
| Charge control agent: | |
| Zinc salicylate derivative (Trademark "BONTRON E84", made by Orient Chemical Industries, Ltd.) | 2 |

The above-mentioned components of the formulation for black toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 μm.

Thus, a black (Bk) color toner No. 4 was obtained.

EXAMPLE 5

[Preparation of Black Toner]

(Formulation for Black Toner No. 5)

| | Parts by Weight |
|---|---|
| Coloring agent: | |
| Carbon black | 6 |
| Resin: | |
| Polyol resin (Mn = 3600, Mw/Mn = 4.2, Tg = 60° C., Softening point = 110° C.) | 90 |
| Styrene-acryl copolymer resin (Mn = 2800, Mw/Mn = 57, Tg = 63° C., Softening point = 137° C.) | 10 |
| Charge control agent: | |
| Zinc salicylate derivative (Trademark "BONTRON E84", made by Orient Chemical Industries, Ltd.) | 2 |

The above-mentioned components of the formulation for black toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 μm.

Thus, a black (Bk) color toner No. 5 was obtained.

EXAMPLE 6

[Preparation of Black Toner]

(Formulation for Black Toner No. 6)

| | Parts by Weight |
|---|---|
| Coloring agent: | |
| Carbon black | 6 |

-continued

| | Parts by Weight |
|---|---|
| Resin: | |
| Polyol resin (Mn = 3600, Mw/Mn = 4.2, Tg = 60° C., Softening point = 110° C.) | 65 |
| Styrene-acryl copolymer resin (Mn = 2800, Mw/Mn = 57, Tg = 63° C., Softening point = 137° C.) | 35 |
| Charge control agent: | |
| Zinc salicylate derivative (Trademark "BONTRON E84", made by Orient Chemical Industries, Ltd.) | 2 |

The above-mentioned components of the formulation for black toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 μm.

Thus, a black (Bk) color toner No. 6 was obtained.

EXAMPLE 7

[Preparation of Black Toner]

(Formulation for Black Toner No. 7)

| | Parts by Weight |
|---|---|
| Coloring agent: | |
| Carbon black | 6 |
| Resin: | |
| Polyester resin (Mn = 5400, Mw/Mn = 3.5, Tg = 61° C., Softening point = 110° C., Acid value = 9) | 80 |
| Styrene-acryl copolymer resin (Mn = 2800, Mw/Mn = 57, Tg = 63° C., Softening point = 137° C.) | 20 |
| Charge control agent: | |
| Zinc salicylate derivative (Trademark "BONTRON E84", made by Orient Chemical Industries, Ltd.) | 2 |

The above-mentioned components of the formulation for black toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 μm.

Thus, a black (Bk) color toner No. 7 was obtained.

EXAMPLE 8

[Preparation of Black Toner]

(Formulation for Black Toner No. 8)

| | Parts by Weight |
|---|---|
| Coloring agent: | |
| Carbon black | 6 |

-continued

| | Parts by Weight |
|---|---|
| Resin: | |
| Polyol resin (Mn = 3600, Mw/Mn = 4.2, Tg = 60° C., Softening point = 110° C.) | 100 |
| Finely-divided particles of polymethyl methacrylate resin (Average particle diameter = 4.0 μm) | 5 |
| Charge control agent: | |
| Zinc salicylate derivative (Trademark "BONTRON E84", made by Orient Chemical Industries, Ltd.) | 2 |

The above-mentioned components of the formulation for black toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 μm.

Thus, a black (Bk) color toner No. 8 was obtained.

EXAMPLE 9

[Preparation of Black Toner]

(Formulation for Black Toner No. 9)

| | Parts by Weight |
|---|---|
| Coloring agent: | |
| Carbon black | 6 |
| Resin: | |
| Polyol resin (Mn = 3600, Mw/Mn = 4.2, Tg = 60° C., Softening point = 110° C.) | 100 |
| Finely-divided particles of titanium oxide (Average particle diameter = 0.3 μm) | 5 |
| Charge control agent: | |
| Zinc salicylate derivative (Trademark "BONTRON E84", made by Orient Chemical Industries, Ltd.) | 2 |

The above-mentioned components of the formulation for black toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 μm.

Thus, a black (Bk) color toner No. 9 was obtained.

EXAMPLE 10

[Preparation of Black Toner]

(Formulation for Black Toner No. 10)

| | Parts by Weight |
|---|---|
| Coloring agent: | |
| Carbon black | 6 |
| Resin: | |
| Polyol resin (Mn = 3600, Mw/Mn = 4.2, Tg = 60° C., Softening point = 110° C.) | 100 |

-continued

| | Parts by Weight |
|---|---|
| Finely-divided particles of titanium oxide (Average particle diameter = 0.3 μm) | 20 |
| Charge control agent: | |
| Zinc salicylate derivative (Trademark "BONTRON E84", made by Orient Chemical Industries, Ltd.) | 2 |

The above-mentioned components of the formulation for black toner were mixed and kneaded under the application of heat thereto in a roll mill, and the thus kneaded mixture was cooled. Then, the mixture was roughly ground in a hammer mill and thereafter pulverized in a jet mill, and classified so as to prepare finely-divided particles with a diameter of 5 to 15 μm.

Thus, a black (Bk) color toner No. 10 was obtained.

Using each of the color toners prepared in Preparation Examples 1 to 10, a two-component developer was obtained in the following manner:

A mixture of 100 parts by weight of each color toner and 0.5 parts by weight of silica was stirred. To 5 parts by weight of the above prepared mixture, 95 parts by weight of iron carrier particles (Trademark "TEFV200/300", made by Nihon Teppun Co., Ltd.) were added, whereby a two-component developer was obtained.

The two-component developers were incorporated in a commercially available electrophotographic copying machine (Trademark "PRETER 550", made by Ricoh Company, Ltd.), and a solid image of a single color (yellow, magenta, cyan or black) was formed on a commercially available transfer sheet (Trademark "TYPE 6000-70W", made by Ricoh Company, Ltd.). In this case, development was carried out in such a manner that the deposition amount of toner on the transfer sheet was increased by 0.20 mg/cm$^2$ within a range of 0.20 to 1.4 mg/cm$^2$, and the image transfer temperature was set to 160° C.

Then, the deposition amount of toner (mg/cm$^2$) was plotted as abscissa, and the glossiness (%) of the solid image formed on the transfer sheet as ordinate.

The results are shown in the FIGURE. As is apparent from the graph, the glossiness of a color toner image provided with gloss increases substantially in proportion to the deposition amount of the color toner on the transfer sheet.

From the graph, a gradient of a glossiness per unit deposition amount of each color toner (mg/cm$^2$) was calculated.

EXAMPLES 1–8 AND COMPARATIVE EXAMPLES 1–3

The two-component color developers prepared from the color toners in Preparation Examples 1 to 10 were incorporated in the above-mentioned electrophotographic copying machine as shown in TABLE 1.

An original carrying thereon a character image and a photographic image was set in the copying machine to produce a full-color copy image. The image quality of the obtained full-color copy image was evaluated in terms of the unevenness of glossiness in the character image and the photographic image.

The results are shown in TABLE 1.

TABLE 1

| | Set of Color Developers (No.) | | | | Gradient of Glossiness per Unit Deposition Amount of Color Toner | | | | | Glossiness (%) | Image Quality | |
|---|---|---|---|---|---|---|---|---|---|---|---|---|
| | Bk | Y | M | C | $a_Y$ | $a_M$ | $a_C$ | a | $a_{BK}$ | Bk | Character Image | Photographic Image |
| Ex. 1 | 3 | 1 | 1 | 1 | 33 | 29 | 32 | 31 | 20 | 15.7 | ○ | ○ |
| Ex. 2 | 4 | 3 | 3 | 3 | 23 | 22 | 20 | 22 | 9 | 7.2 | ○ | Δ |
| Ex. 3 | 5 | 1 | 1 | 1 | 33 | 29 | 32 | 31 | 19 | 15.4 | ○ | ○ |
| Ex. 4 | 6 | 1 | 1 | 1 | 33 | 29 | 32 | 31 | 14 | 11.2 | ○ | ○ |
| Ex. 5 | 7 | 2 | 2 | 2 | 38 | 37 | 35 | 37 | 21 | 17.2 | ○ | ○ |
| Ex. 6 | 8 | 1 | 1 | 1 | 33 | 29 | 32 | 31 | 17 | 14.8 | ○ | ○ |
| Ex. 7 | 9 | 1 | 1 | 1 | 33 | 29 | 32 | 31 | 17 | 13.3 | ○ | ○ |
| Ex. 8 | 10 | 1 | 1 | 1 | 33 | 29 | 32 | 31 | 13 | 9.8 | ○ | Δ |
| Comp. Ex. 1 | 1 | 1 | 1 | 1 | 33 | 29 | 32 | 31 | 30 | 24 | x | ○ |
| Comp. Ex. 2 | 2 | 2 | 2 | 2 | 38 | 37 | 35 | 37 | 35 | 29.2 | x | ○ |
| Comp. Ex. 3 | 3 | 3 | 3 | 3 | 23 | 22 | 20 | 22 | 20 | 15.7 | x | Δ |

Deposition amount of toner: 0.8 mg/cm$^2$
Evaluation of image quality
○: The image was attractive with even glossiness.
Δ: There was slight unevenness in glossiness.
x: The glossiness was considerably uneven.

According to the image formation method of the present invention, as previously explained, the glossiness of a black image portion, which tends to increase because the deposition amount of black toner is increased relatively to the deposition amounts of other color toners such as yellow, magenta and cyan toners, can be effectively reduced, so that a photographic image including a black portion and a black character image become attractive with even glossiness.

Japanese Patent Application No. 09-092745 filed Mar. 28, 1997 is hereby incorporated by reference.

What is claimed is:

1. A set of a yellow toner, a magenta toner, a cyan toner and a black toner, for forming a full-color image by superimposing on a transfer sheet four yellow, magenta, cyan and black toner images which are respectively obtained by developing four latent electrostatic images, which respectively correspond to said four yellow, magenta, cyan and black toner images, with said yellow toner, said magenta toner, said cyan toner and said black toner, wherein a gradient $a_Y$ of a yellow glossiness per unit amount of said yellow toner (mg/cm$^2$) deposited on said transfer sheet, a gradient $a_M$ of a magenta glossiness per unit amount of said magenta toner (mg/cm$^2$) deposited on said transfer sheet, and a gradient $a_C$ of a cyan glossiness per unit amount of said cyan toner (mg/cm$^2$) deposited on said transfer sheet are in a range of 0.8 a to 1.2 a and a gradient $a_{BK}$ of a black glossiness per unit amount of said black toner (mg/cm$^2$) deposited on said transfer sheet is in a range of 0.4 a to 0.7 a in which $a=(a_Y+a_M+a_C)/3$, wherein each of said color toners comprises a coloring agent and a binder resin, wherein said black toner comprises a glossiness controlling agent in the form of finely divided particles with a particle diameter of 0.1 to 0.8 $\mu$m;

and wherein said glossiness controlling agent is contained in an amount of 0.2 to 15 wt. % of the total weight of said black toner.

2. The set as claimed in claim 1, wherein the softening points ($SP_{YMC}$) of said binder resins for use in said yellow toner, said magenta toner and said cyan toner, and the softening point ($SP_{BK}$) of said binder resin for use in said black toner satisfy the relationship of $SP_{YMC}+10 \leqq SP_{BK} \leqq SP_{YMC}+20$.

3. The set as claimed in claim 1, wherein said binder resin for use in said black toner comprises a plurality of resin components, with at least one resin component being incompatible with other resin components.

4. The set as claimed in claim 1, wherein said binder resins for use in said yellow toner, said magenta toner and said cyan toner comprise a polyol resin, and said binder resin for use in said black toner comprises a polyol resin and a styrene-acryl copolymer resin.

5. The set as claimed in claim 4, wherein the mixing ratio by weight of said polyol resin to said styrene-acryl copolymer resin for use in said black toner is in a range of (95:5) to (60:40).

6. The set as claimed in claim 4, wherein the softening point of said styrene-acryl copolymer resin is higher than that of said polyol resin by 10° C. or more.

* * * * *

UNITED STATES PATENT AND TRADEMARK OFFICE

CERTIFICATE OF CORRECTION

PATENT NO. : 6,268,098 B1
DATED : July 31, 2001
INVENTOR(S) : Sugimoto et al.

It is certified that error appears in the above-identified patent and that said Letters Patent is hereby corrected as shown below:

Column 5,
Line 39, [$CaCO_{31}$] should read -- $CaCO_3$ --.

Column 13,
Line 10, [4.0] should read -- 0.4 --.

Signed and Sealed this

Seventh Day of May, 2002

*Attest:*

*Attesting Officer*

JAMES E. ROGAN
*Director of the United States Patent and Trademark Office*